US012687033B2

(12) United States Patent
Rose et al.

(10) Patent No.: US 12,687,033 B2
(45) **Date of Patent: *Jul. 21, 2026**

(54) PARALLELOGRAM ARTICULATED LATTICE MAST FOR PASSIVE (SELF) DEPLOYMENT

(71) Applicant: Southwest Research Institute, San Antonio, TX (US)

(72) Inventors: Thomas J. Rose, Erie, CO (US); Thomas J. Harvey, Nederland, CO (US); Toby J. Harvey, Enoch, UT (US); Randy J. Rose, Broomfield, CO (US)

(73) Assignee: Southwest Research Institute, San Antonio, TX (US)

( * ) Notice: Subject to any disclaimer, the term of this patent is extended or adjusted under 35 U.S.C. 154(b) by 314 days.

This patent is subject to a terminal disclaimer.

(21) Appl. No.: 18/333,168

(22) Filed: Jun. 12, 2023

(65) Prior Publication Data

US 2024/0410195 A1 Dec. 12, 2024

(51) Int. Cl.
*E04H 12/18* (2006.01)

(52) U.S. Cl.
CPC ..... *E04H 12/187* (2013.01); *E04H 12/185* (2013.01)

(58) Field of Classification Search
CPC ..... E04B 1/003; E04B 1/185; E04B 1/1903; E04B 2001/2415; E04B 2/789; E04C 2003/0473; E04H 12/187; E04H 12/18; E04H 12/185; B64G 1/2222; B64G 1/2224; F24S 2025/012
See application file for complete search history.

(56) References Cited

U.S. PATENT DOCUMENTS 4,599,832 A * 7/1986 Benton ..... E04H 12/185 52/645
4,958,474 A * 9/1990 Adams ..... B64G 99/00 52/118
5,228,258 A * 7/1993 Onoda ..... B64G 99/00 343/915
5,509,747 A * 4/1996 Kiendl ..... B64G 1/44 244/172.6
6,323,827 B1 * 11/2001 Gilger ..... H01Q 15/161 343/915
8,562,236 B2 * 10/2013 Eikelenboom ..... E05D 3/122 16/221
9,660,351 B2 * 5/2017 Medzmariashvili ..... H01Q 15/161

(Continued)

FOREIGN PATENT DOCUMENTS

WO WO-2014127813 A1 * 8/2014 ..... B64G 1/222

*Primary Examiner* — Theodore V Adamos
(74) *Attorney, Agent, or Firm* — Livingston Law Firm

(57) ABSTRACT

A self-deployable mast, typically for supporting a payload. The mast has top longerons, bottom longerons, and hinge linkages that form a series of moveable parallelograms operable to fold and unfold. The mast further has springs and truss diagonals, with at least one spring and one truss diagonal associated with each of the parallelograms. The springs are operable to deploy the mast from a folded position to a deployed position. Each truss diagonal is operable to become in tension diagonally across its associated parallelogram once the mast is deployed into a final position. In other embodiments, motors may be used instead of springs.

8 Claims, 12 Drawing Sheets

(56) References Cited

U.S. PATENT DOCUMENTS

| | | | | |
|---|---|---|---|---|
| 11,799,414 | B1 * | 10/2023 | Harvey | H02S 30/20 |
| 2005/0126106 | A1 | 6/2005 | Murphy et al. | |
| 2007/0145195 | A1 * | 6/2007 | Thomson | B64G 1/2222 244/172.6 |
| 2009/0057492 | A1 * | 3/2009 | Harris | B64G 1/244 244/171.1 |
| 2016/0362892 | A1 * | 12/2016 | Murphey | E04C 3/28 |

* cited by examiner

PARALLELOGRAM ARTICULATED LATTICE MAST FOR PASSIVE (SELF) DEPLOYMENT

TECHNICAL FIELD OF THE INVENTION

This patent application relates to passively deployable equipment, and more particularly to masts for such equipment.

BACKGROUND OF THE INVENTION

Various masts, booms, arms, and the like, are used in different applications for holding a payload, such as a piece of equipment, over or above a space. For example, in communications applications, a "mast" is a generally vertical structure that supports an antenna at a height where it can satisfactorily send or receive radio waves. As another example, a "boom" may be used for extending a microphone closer to the source of a sound to be amplified.

As used herein, "mast" is used collectively to include booms, arms, and any similar slender rigid structure, typically having a lattice or tubular construction. The mast is assumed to be capable of providing appropriate support to a payload. The payload may be a "tip mass" at the end of the mast or may have its mass distributed along all or part of the mast.

Self-deployable masts and their payloads are sometimes used in space or in unsafe environments, or for other applications where human operators are not readily available. These mast/payload systems are often stowed as compact modules during travel and deployed once in a desired location.

U.S. patent application Ser. No. 18/100,472, entitled "Passively Deployable Solar Panel Array With Truss Backing" describes a solar panel array for use in space, with a truss backing to provide support for the solar panels. The truss backing is a mast that is integrated with the solar array to form a self-deployable structure.

Fully actuated and controlled (non passive) deployments typically use motors, which add power and mechanism risks to the deployment. Often, the indeterminacy of some passively deployed systems leads to heightened risk, which can drive requirements for a controlled deployment using additional motors. These add weight, complexity, and overall cost to the system.

Some self-deployed systems are referred to as "passively" deployed systems because although deployment (unfolding) of the equipment may be initiated actively it is then completed without external control. At a desired time, one or more actuators are used to initiate deployment. Many systems that rely on passive deployment have a mechanically indeterminate deployment, which can lead to heightened risk of damage or poor operation of the system.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to a passively deployable mast, typically used to vertically or horizontally support a payload. The mast comprises a series of parallelogram articulated sections that deploy in a deterministic manner.

Figure 1:
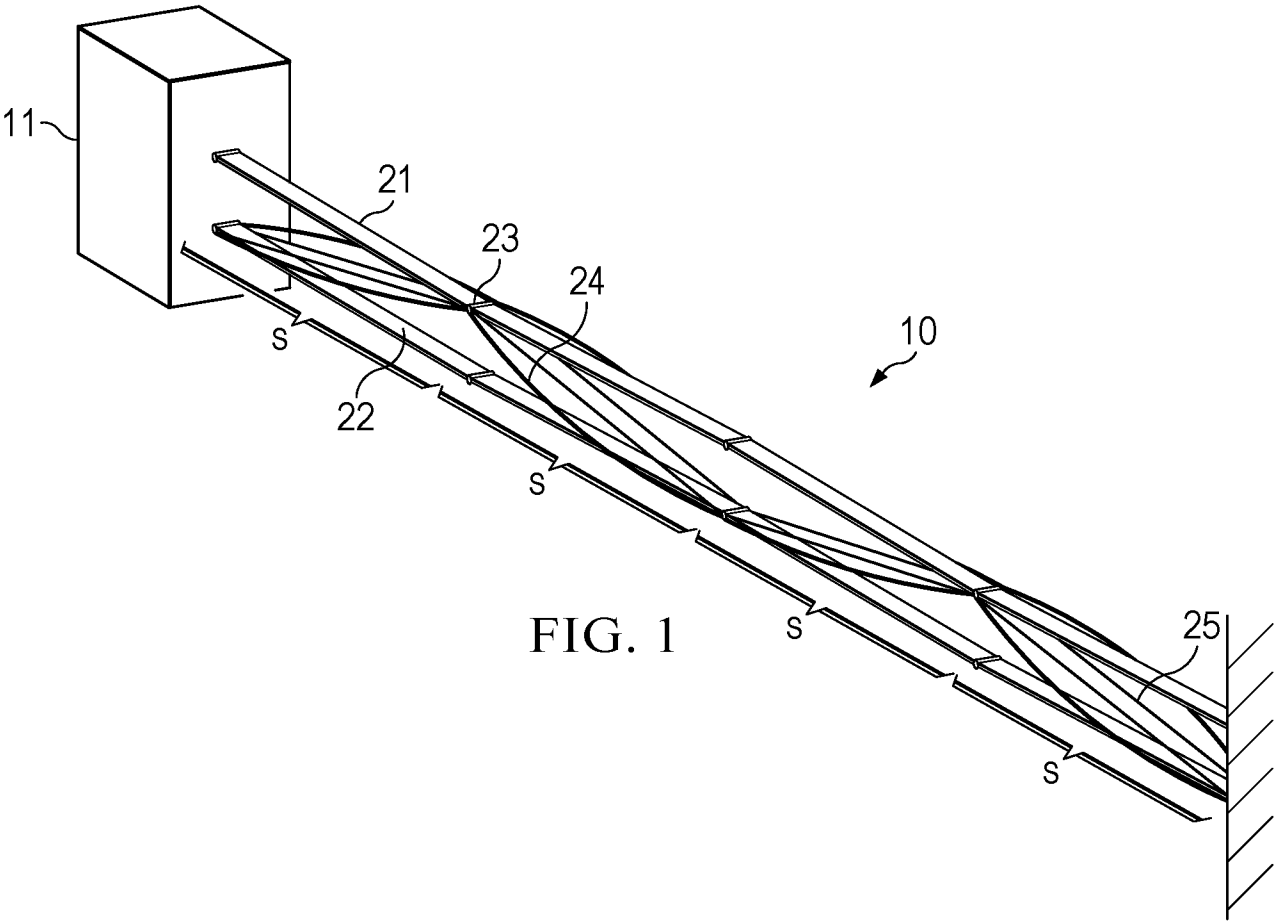
FIG. 1 is a perspective view of the mast in a deployed state, supporting a piece of equipment.

FIG. 1 is perspective view of a mast 10 in accordance with the invention. In FIG. 1, mast 10 is in its deployed (unfolded) position.

In the example of FIG. 1, mast 10 has been deployed from a base station at one end. It supports a payload 11 at the other end. Payload 11 is represented as a "black box" and is a tip mass, that is, it is mounted at the end of mast 10. In other applications, the payload may be located anywhere on the mast or may be distributed along the length of the mast. The payload is often a piece of equipment. It may be any device, for example a camera or other inspection or data collection device. As another example, payload 11 may be a tool, robotic or remotely operated mechanically.

The base station from which mast 10 is deployed is not explicitly shown. The base station may be stationery or may be mobile. Mast 10 is deployable in gravity or non-gravity environments.

The sizing of mast 10 is typically driven by the size of the payload 11 it is to support. Payloads having larger mass may call for a shorter reach and heavier mast, whereas less massive payloads may allow a longer reach and lighter mast design. Various electrical connections or other wiring or cabling from payload 11 to the base station may be conventionally achieved and are not shown.

An example application for mast 10 is a mast system launched into space. In order to fit the mast system (mast 10 and its accompanying payload 11) in a launcher, the mast system is folded and stowed in the launcher. Once the launcher has reached the desired orbit, the mast system is deployed. Deployment occurs such that the system goes from a stowed state to an operational (deployed) state. A feature of the invention described herein is that deployment is "synchronized" in the sense that the entire mast 10 deploys simultaneously, rather than in a sequence of actuations.

Thus, mast 10 provides a means for deploying payload 11 to a desired position above or out from its base station, as well as supporting payload 11 after deployment. Mast 10 provides a desired stiffness to support payload 11 out at the desired reach.

When mast 10 is deployed as in FIG. 1, it forms a rigid structure along its length. After deployment, mast 10 is a trussed structure comprising a series of repeating sections, S, also referred to as "bays" in mast applications. In the example of FIG. 1, mast 10 has four sections. Each section has two rigid longerons 21 and 22, with hinge linkages 23 separating the sections. Each section also has associated springs 24 and truss diagonals 25.

In FIG. 1, each section, S, has one top longeron 21, one bottom longeron 22, two springs 24, and two truss diagonals 25. Longerons 21 and 22 are flat and planar and made from a single piece of rigid material, but could also be tubular or have some other flat rigid construction.

In this deployed state, springs 24 have assisted in deployment by providing a constant spring force. Truss diagonals 25 have been placed into tension, giving the entire length of mast 10 its desired rigidity. The structure and operation of springs 24 and truss diagonals 25 are further explained below.

The springs 24 and truss diagonals 25 are mirrored left to right. In other embodiments, one or more of these components could be reduced to single components. There is not necessarily a one-to-one relationship between the number of springs and the number of truss diagonals.

Hinge linkages 23 connect the sections, S. Geometrically, between hinge linkages 23, the top and bottom longerons of each section form a series of parallelograms. Hinge linkages 23 allow mast 10 to be folded in an accordion-like manner in its undeployed state. As mast 10 deploys, hinge linkages 23 allow the interior geometry of each parallelogram to "unfold", that is, to open and become less flat and more rectangular. Hinge linkages 23 may be configured with a variety of mechanisms, with several examples being described below.

In the embodiment of FIG. 1, each section has two springs 24 and two truss diagonals 25, with one spring and truss diagonal on one side of the longerons and the other spring and truss diagonal on the other side of the longerons. On each side, a truss 25 is attached to a corner of a bottom longeron 21 and to the opposing corner of a top longeron 22. In other words, truss diagonals 25 run diagonally across the sides of the parallelograms.

Springs 24 are similarly attached diagonally but may also be attached offset from the corners. Springs 24 are on one side and the other of their associated section, but may be otherwise arranged so long as they are functional to open the mast 10 as described herein.

Truss diagonals 25 are configured to run "bottom to top" in a first section, then "top to bottom" in a next section. Thus, the truss diagonals 25 run in the same diagonal direction within each section, but the diagonal direction alternates from section to section.

In FIG. 1, truss diagonals 25 have become in a tensioned state, having been tensioned by the opposing force of springs 24 during deployment. The deployment process is described below.

Figure 2:
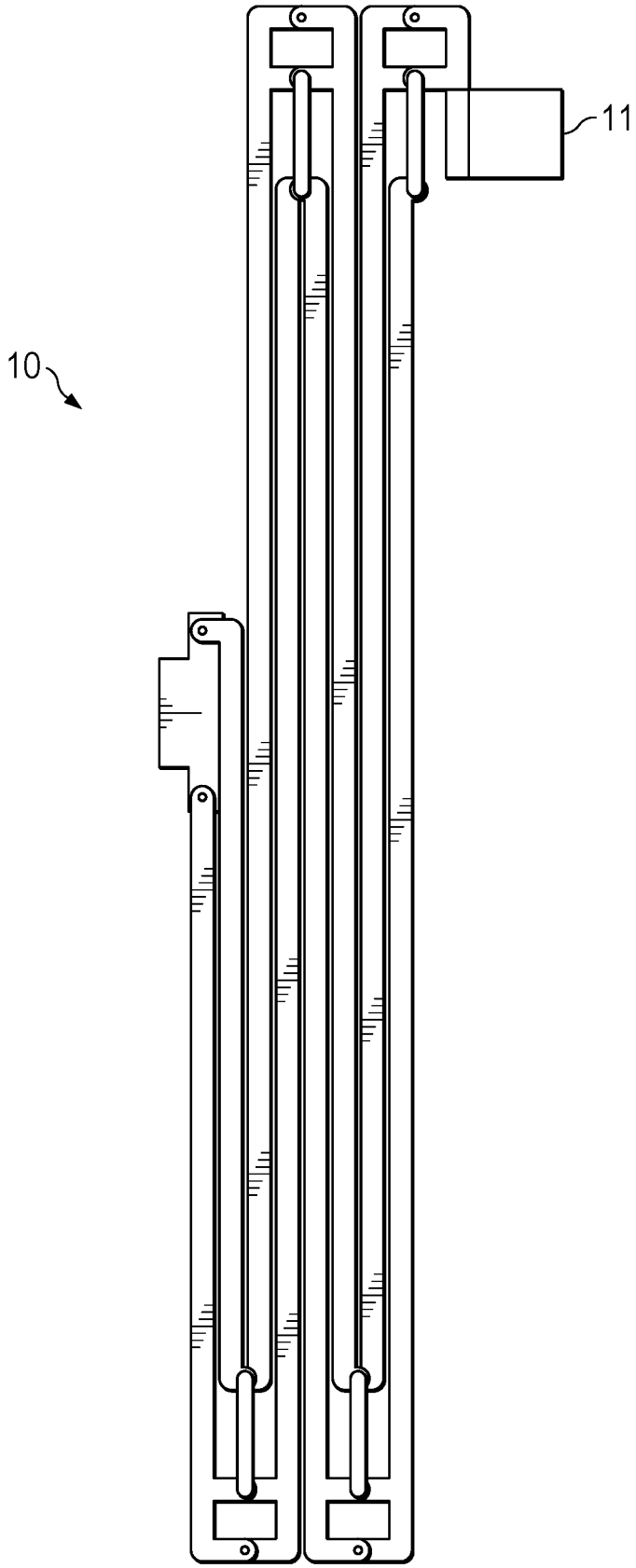
FIG. 2 is a side view of the mast in a folded (undeployed) state.

FIG. 2 is a side view of mast 10 in a folded (undeployed) state. As illustrated, for stowage, hinge linkages 23 allow mast 10 to be folded, resulting in a compact package. Springs 24 and truss diagonals 25 are not shown. In this view, the parallelograms formed by the sections are in their "flat" or "closed" state as opposed to the "open" rectangular shape they have after deployment.

The sections of mast 10 are folded in an accordion-like manner, with alternating folds. Typically, the mast sections are the same length, resulting in a series of symmetrical folds or "zig-zags".

Figure 3:
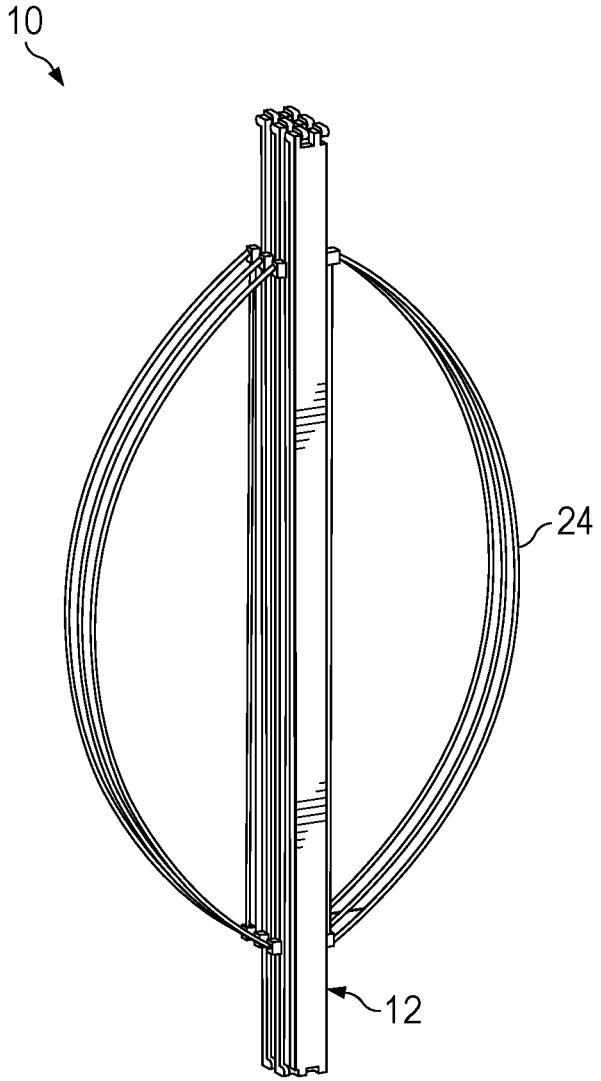
FIG. 3 is a top view of the mast in an undeployed state.

FIG. 3 is a bottom view of mast 10 in an undeployed state. Springs 24 are implemented as "buckled battens", e.g. narrow strips of a thin flexible material. An example of a suitable material is a fiberglass rod. The battens are buckled (pre-loaded), such that when released, within each section, they will push against hinge linkages 23 as described below.

Other possible implementations for springs 24 are torsion springs, torsion rods, or compression springs. Various passive mechanisms that apply a constant spring force during deployment may be used.

Although not shown, various damper mechanisms may be desirable to control deployment. A single damper at the interface may be sufficient.

Truss diagonals 25 are not shown in FIG. 3 but are in a slack (untensioned) state when mast 10 is undeployed. Truss diagonals 25 may be implemented with flexible strips, cables, wires, cords, or rods, or other flexible elongated material capable of being tensioned from a slack state in response to the forces of springs 24 during deployment. This tension is applied diagonally across the parallelograms formed by the top and bottom sections and linkages. A flexible strip or carbon cord, such as a batten shorter than the spring batten, that is stiff axially could be advantageous.

Figure 4:
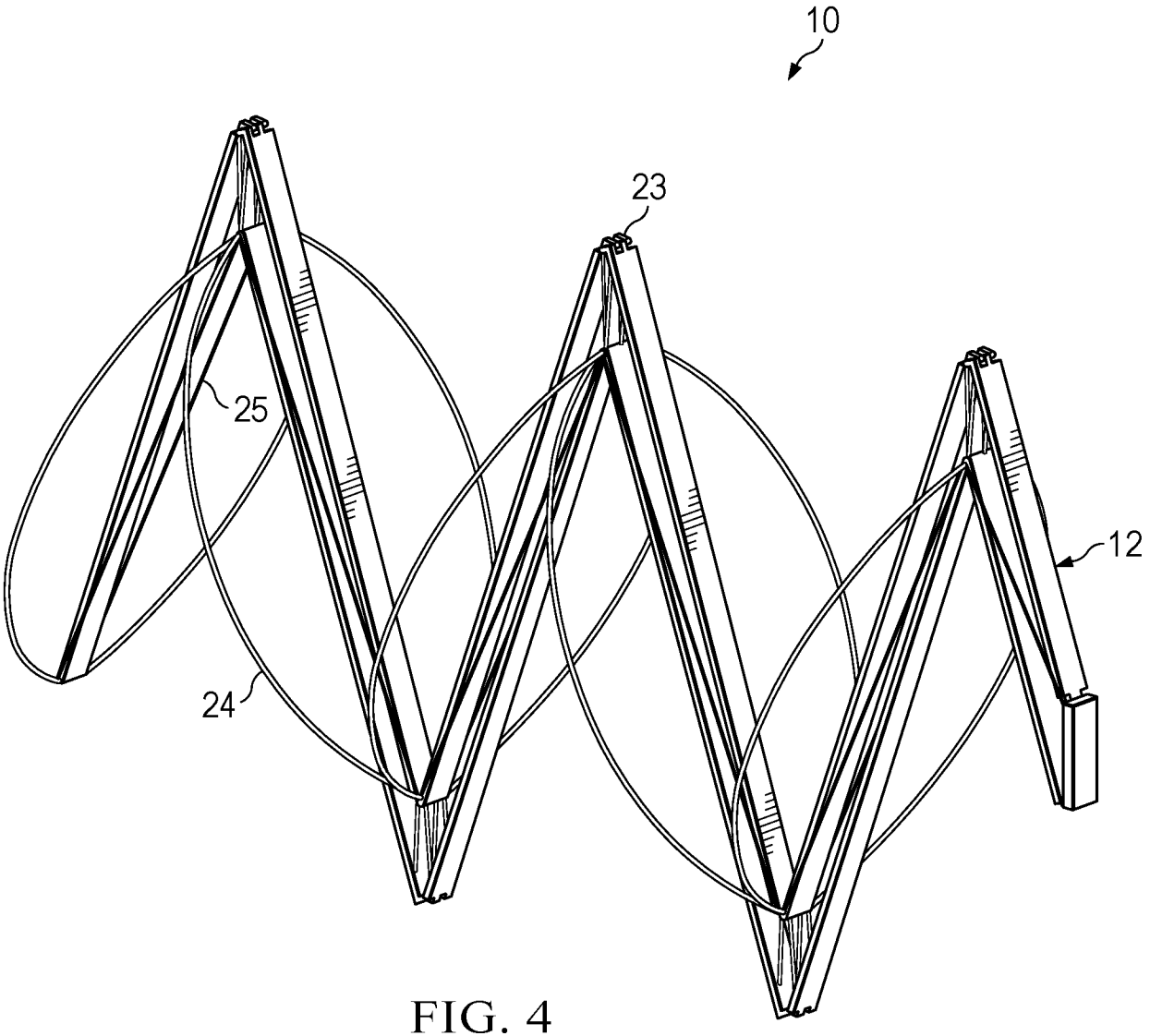
FIG. 4 illustrates the mast in mid-deployment.

FIG. 4 illustrates mast 10 in mid-deployment. Hinge linkages 23 allow this folding and unfolding of mast 10. Specifically, hinge linkages 23 allow the parallelograms (formed by the top and bottom longerons) to change shape from their closed folded shape to a more open rectangular shape as the mast deploys.

Of particular interest in FIG. 4 is the operation of springs 24 and truss diagonals 25. Mast 10 has been actuated, such that springs 24 have been released and are pushing the mast 10 out and away from its point of attachment to the base station (satellite or other). Elastic energy stored in springs 24 during folding provides deployment force. In this state, truss diagonals 25 still are slack. Hinge linkages 23 keep mast 10 straight and its angles matching throughout deployment.

Figure 5:
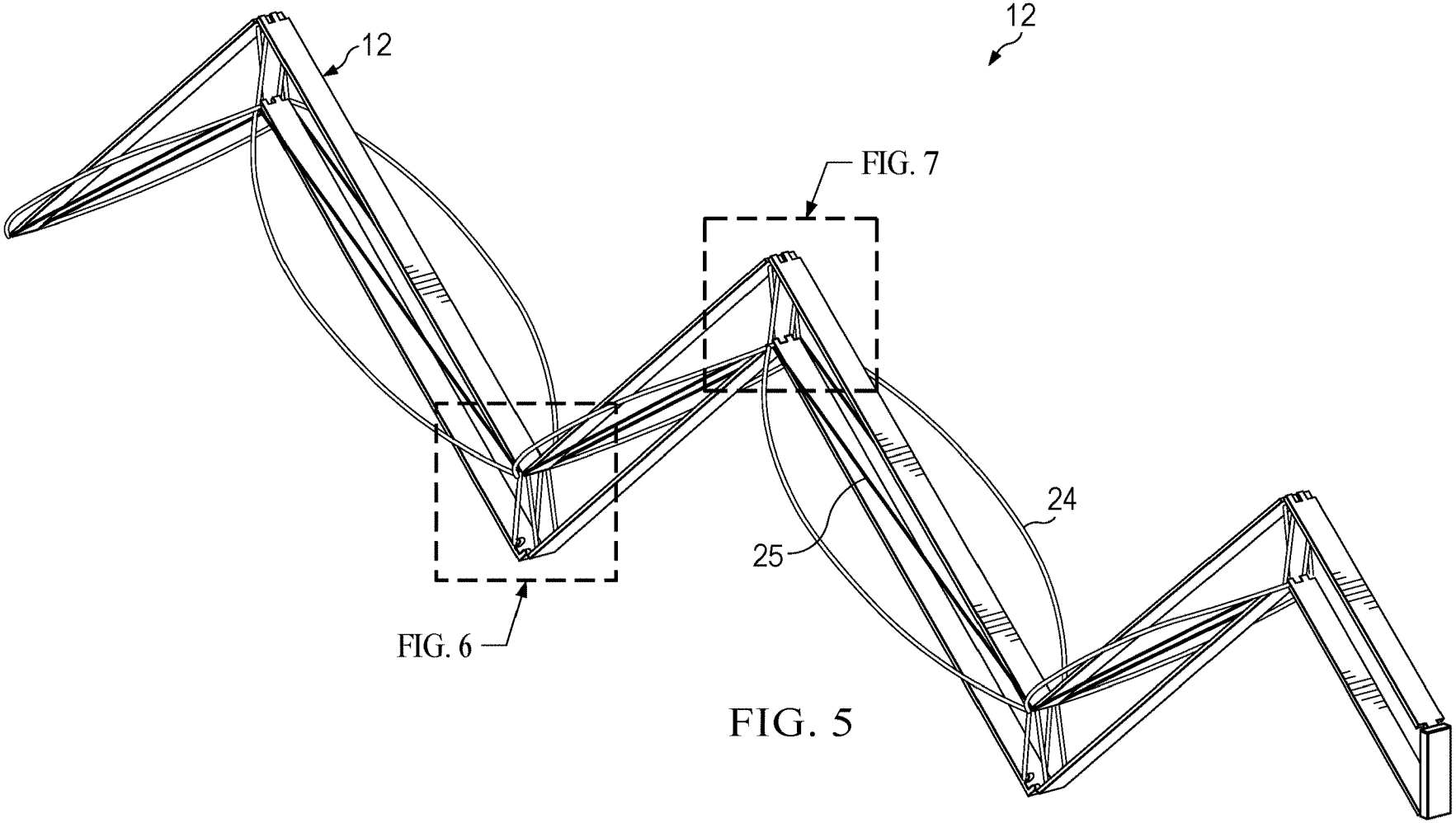
FIG. 5 is a second view during deployment of the mast, at a time subsequent to FIG. 4.

FIG. 5 is another view of mid-deployment of the mast 10 during deployment at a time subsequent to FIG. 4. At this stage of deployment, springs 24 continue their deployment force. Truss diagonals 25 are still slack. Hinge linkages 23 continue to keep the sections of mast 10 in line and to keep deployment synchronized and deterministic.

Figure 6:
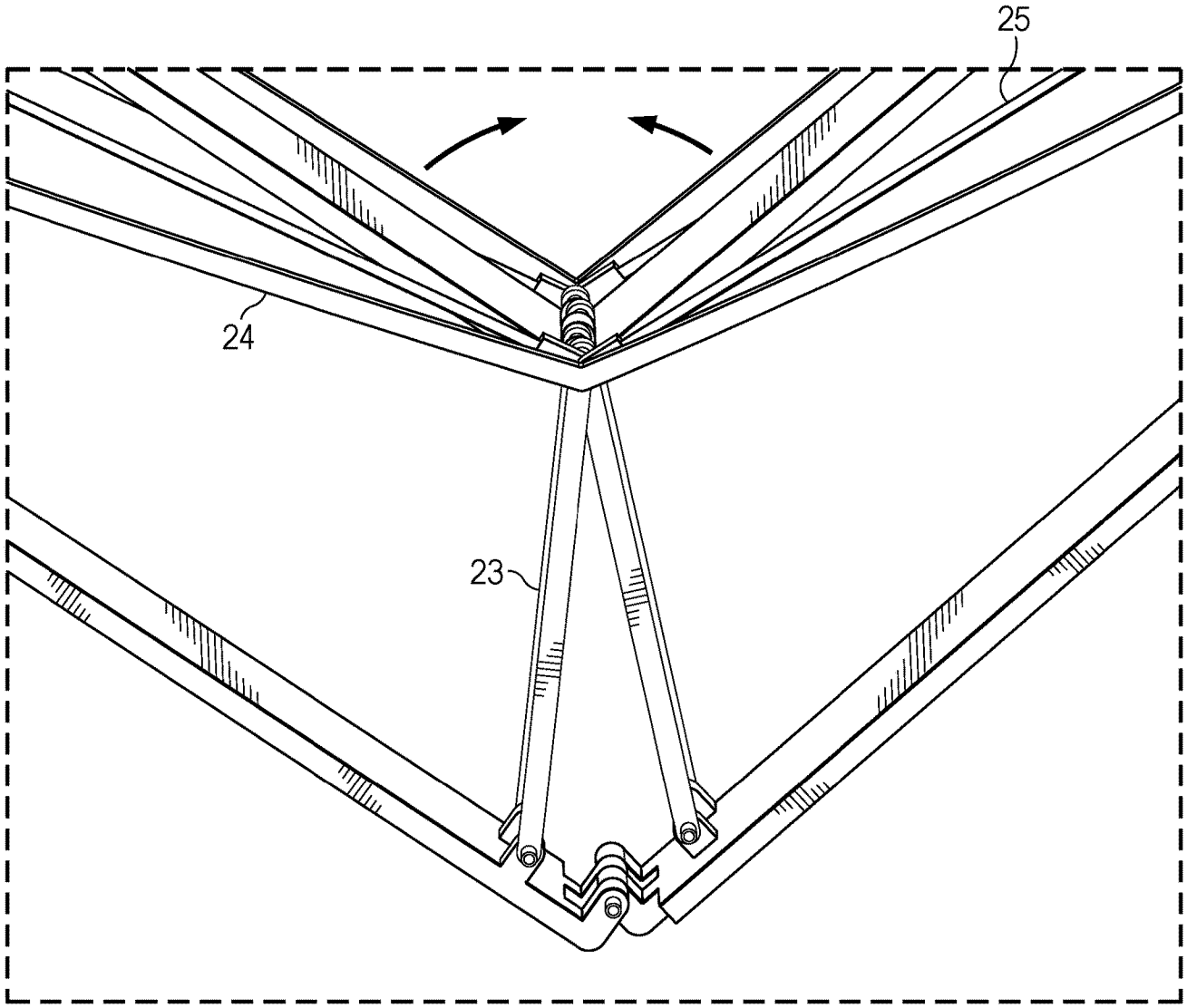
FIGS. 6 and 7 are detailed views of the valleys (FIG. 6) and peaks (FIG. 7) of FIG. 5.
Figure 7:
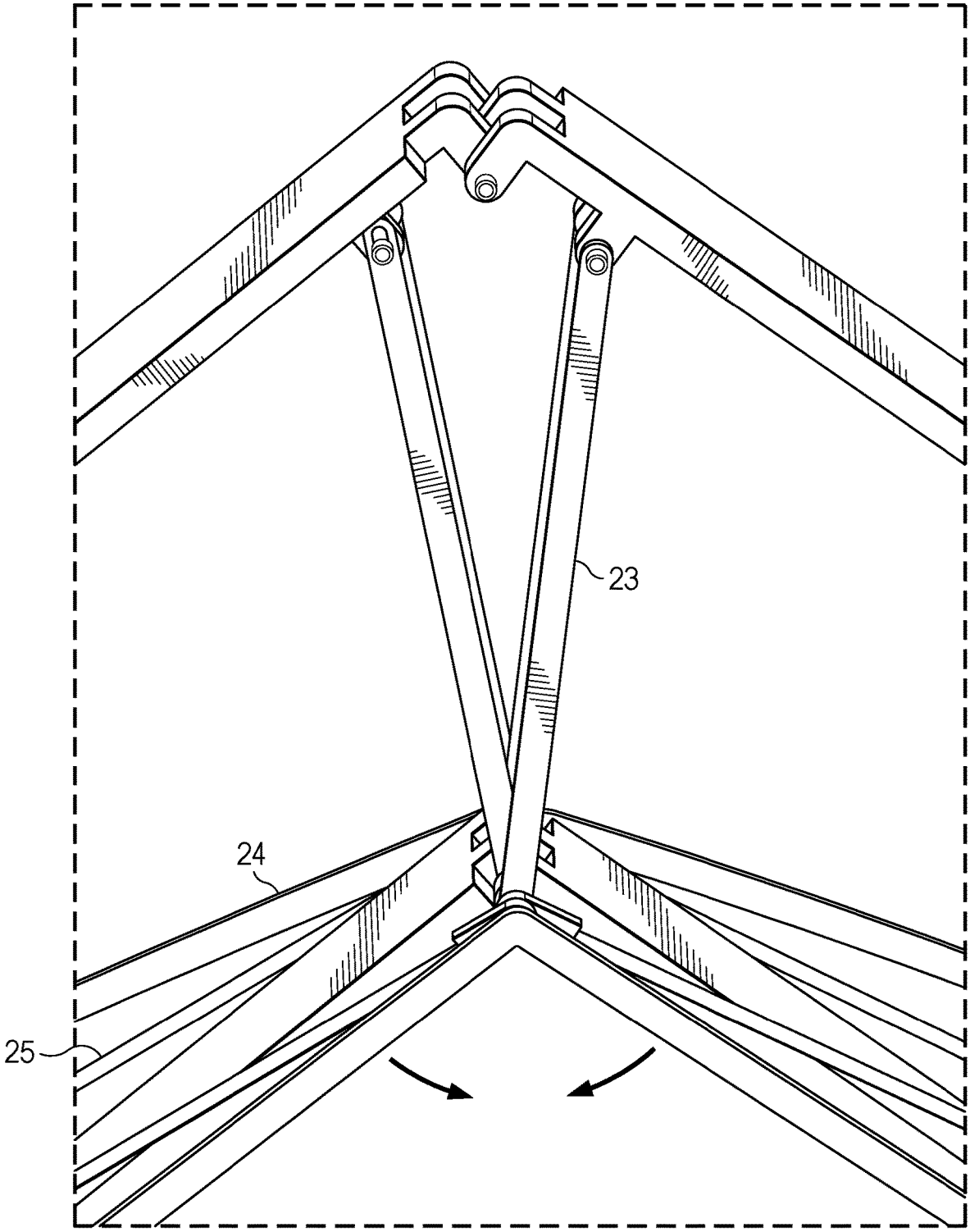

FIGS. 6 and 7 are detailed views of the valleys (FIG. 6) and peaks (FIG. 7) of FIG. 5. Hinge linkages 23 are described in detail below.

Figure 8:
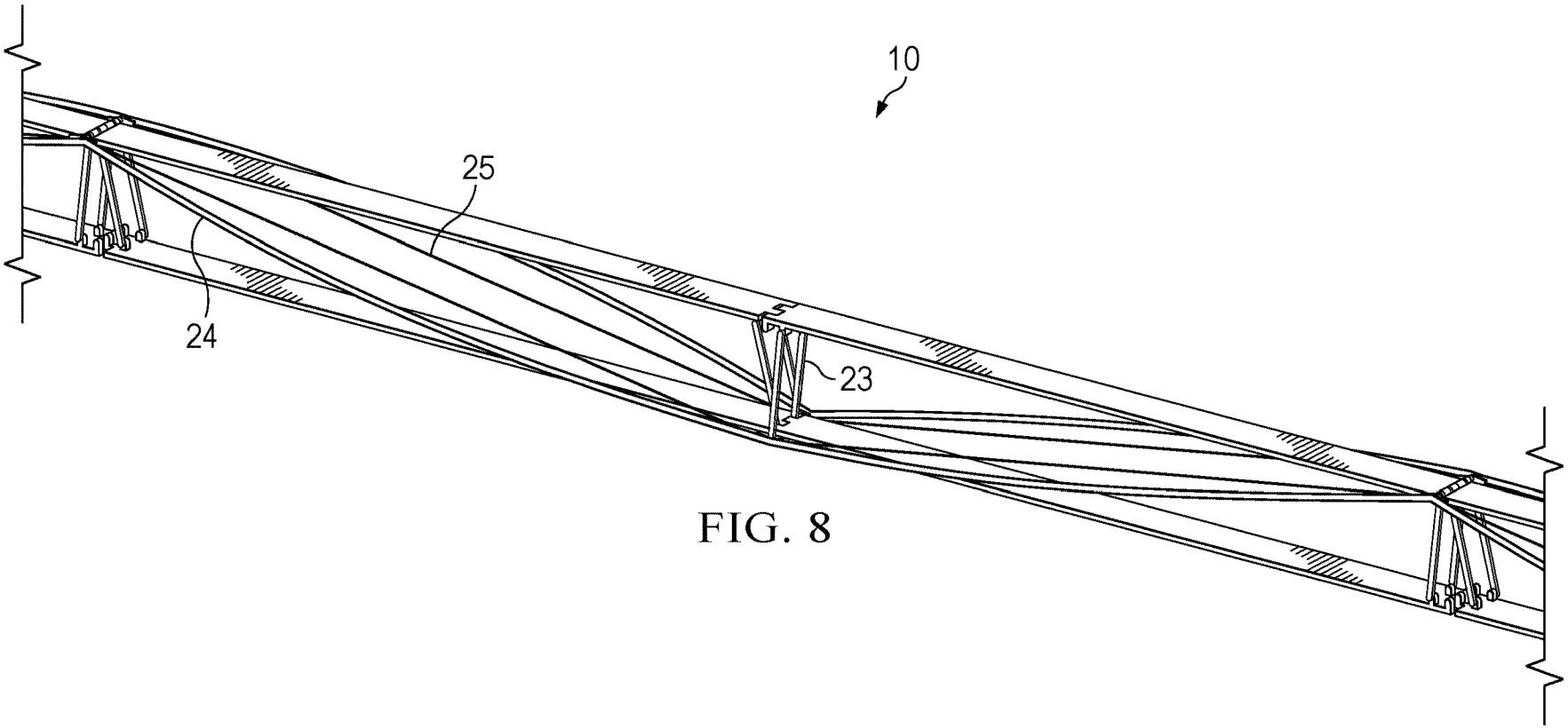
FIG. 8 illustrates a portion of the mast in full deployment.

FIG. 8 illustrates a portion of mast 10 in full deployment. Springs 24 continue applying force to each section of mast 10. Truss diagonals 25 have become tensioned as a result of the forces of springs 24. Slop in linkages 23 allows for truss diagonals 25 to control the end position section of mast 10 and to create the tensioned mast 10.

Hinge linkages 23 are "active" only during deployment, in the sense that their operational role is finished once solar array is deployed. During deployment, hinge linkages 23 provide uniform deployment but once the mast is deployed they are structurally invisible.

Figure 9:
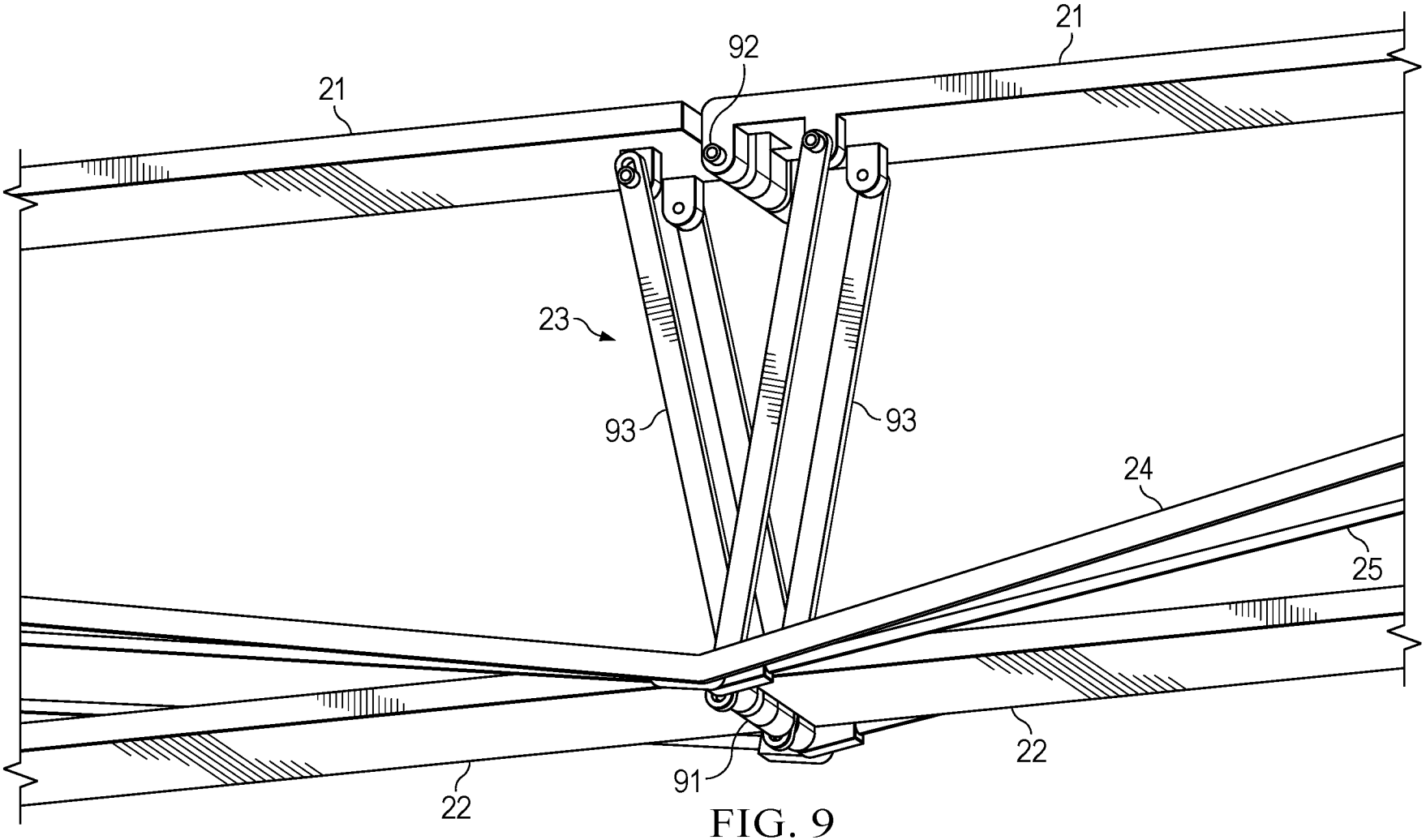
FIG. 9 illustrates one example of a hinge linkage.

FIG. 9 illustrates one example of a hinge linkage 23. Here, mast 10 is in a deployed state and truss diagonals 25 are tensioned as described above. The longerons 21 and 22 of each section are fully spaced apart and the parallelogram they form is open from being flat to being more rectangular. Hinge linkages 23 are open to a "v" shape in this deployed state of mast 10.

In the embodiment of FIG. 9, each hinge linkage 23 has a first hinge 91 that connects two adjacent longerons of adjoining sections of mast 10. A second hinge 92 connects the other two adjacent longerons. Here, hinge 91 connects two bottom longerons 22, and hinge 92 connects two top longerons 21. However, as illustrated in the preceding figures, hinge linkages 23 alternate in their orientation between sections, such that hinge 91 and hinge 92 alternatingly connect top and bottom longerons. This arrangement allows mast 10 to be folded as described above.

Hinge 91 is a pivoting hinge, slightly offset to allow its two longerons to fold against each other. Hinge 92 is also an offset hinge (more offset than hinge 91) that allows its two longerons to be spaced apart when mast 10 is folded, such that these two longerons fold on the outside of the other two longerons of adjoining sections. This flattening and accordion-folding of the longerons is illustrated above in connection with FIGS. 2 and 3.

Hinge linkage 23 further has two pairs of linkage arms 93. The linkage arms 93 form the "v" shape of hinge linkage 23. All linkage arms 93 are attached at one end to hinge 91 and extend from the apex of the v shape of hinge linkage 23. One pair of arms 93 extends from hinge 91 to one of the opposing longerons and the other pair of arms 93 extends to the other of the opposing longerons, all extending so as to connect to the respective longerons at a point near offset hinge 92.

Referring again to the above-described figures, hinge linkages 23 are oriented such their v-shape is up or down, alternating between sections of mast 10.

Figure 10:
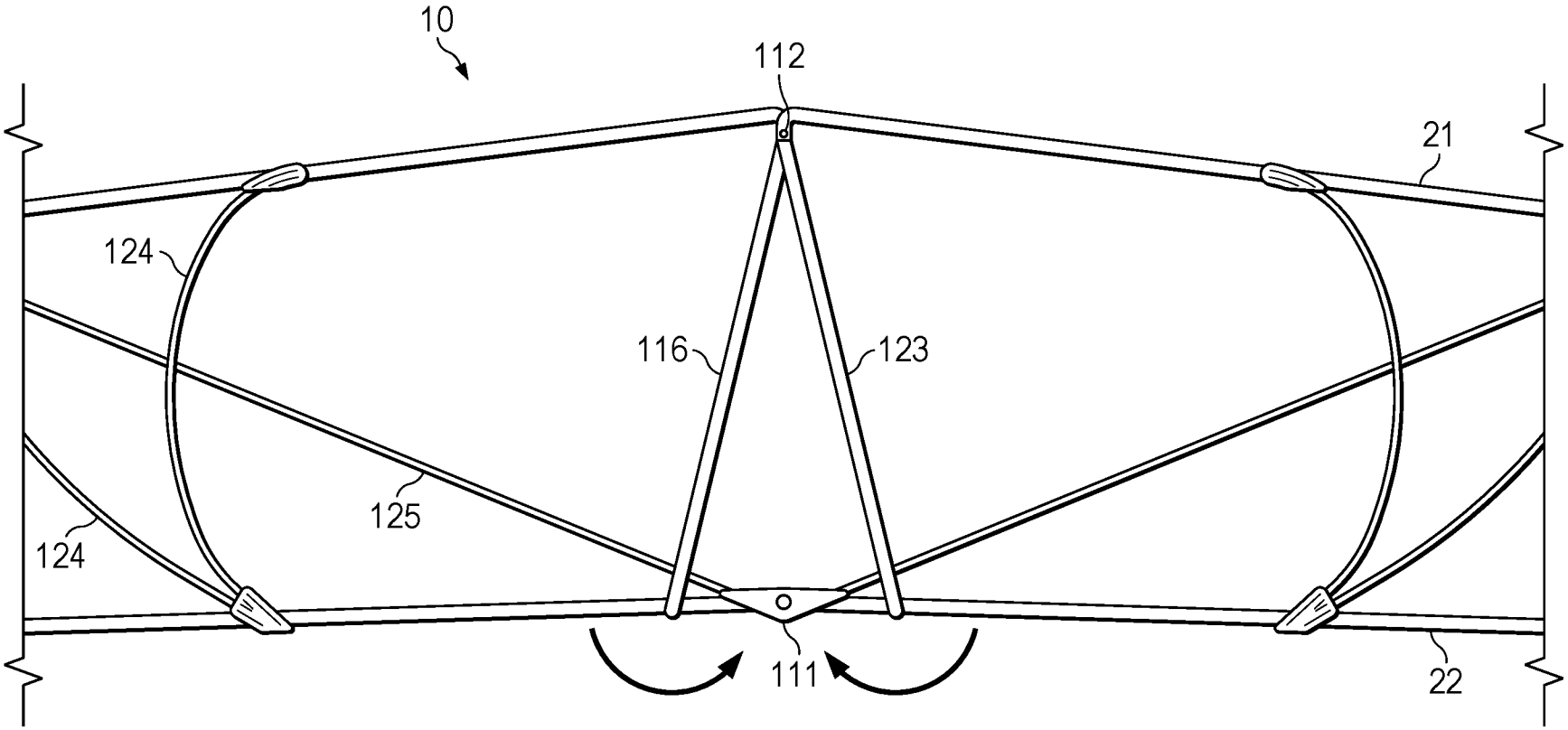
FIG. 10 illustrates the mast with alternative embodiments of springs and hinge linkages.

FIG. 10 illustrates mast 10 with alternative embodiments of springs and hinge linkages. Springs 124 and/or hinge linkages 123 may be used with the above-described mast 10.

Like the embodiment of FIG. 9, each hinge linkage 123 has a first hinge 111 that connects two adjacent longerons of adjoining section of mast 10. A second hinge 112 connects the other two adjacent longerons. Here, hinge 111 connects two bottom longerons 22 and hinge 112 connects two top longerons 21. Like hinge linkages 23, hinge linkages 123 alternate in their orientation between sections, such that hinge 111 and hinge 112 alternatingly connect top and bottom longerons.

Hinge 111 is a pivoting hinge, slightly offset to allow its two longerons to fold against each other. Hinge 112 is also an offset hinge that allows its two longerons to fold on the outside of two other longerons of adjoining sections. This arrangement allows mast 10 to be accordion-folded as described above.

Hinge linkage 103 is again v-shaped. Its linkage arms 116 extend from hinge 112 and top longerons 21 to bottom longerons 22, with a connection point on bottom longerons 22 that is offset from the hinge 111.

As with hinge linkages 23, hinge linkages 103 are oriented such that the v-shape is up or down, alternating between sections of the mast. However, in this embodiment, the ends of the longerons 21 attached to the linkage arms 116 fold into the v-shape of hinge linkage 123. This folding direction is indicated by the arrows in FIG. 10.

Each section has two springs 124, attached between the longerons 21 and 22, one on each side of the longerons. These springs 124 are attached closer to the midpoints of the longerons rather than at their diagonal ends. Like all other embodiments, springs 24 function to push the top longeron 21 and bottom longeron 22 apart during deployment and to tension the diagonals 125.

As in other embodiments, trusses 125 are attached diagonally from a hinge 111 of one section to a hinge 111 of a next section. The alternating diagonal pattern of trusses 125 is maintained by the alternating orientations of hinge linkages 123.

Figure 11:
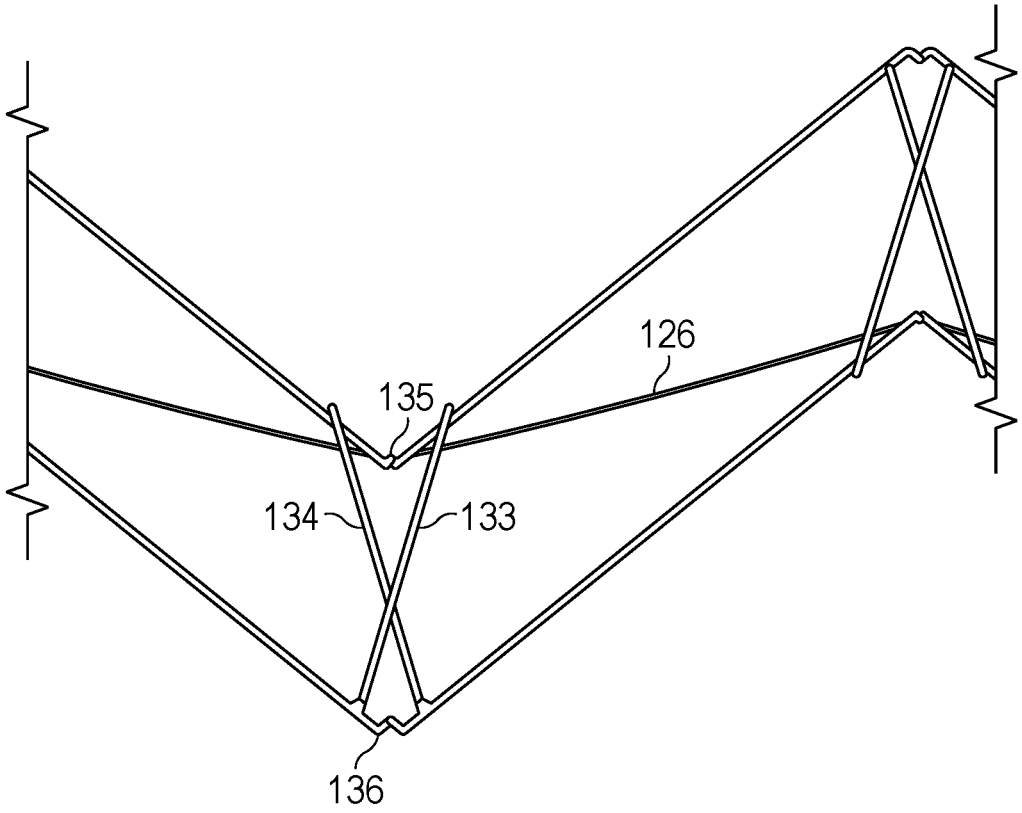
FIG. 11 illustrates an embodiment of the mast in which the hinge linkages are x-shaped rather than v-shaped.

FIG. 11 illustrates an embodiment of mast 10 in which hinge linkages 133 are x-shaped rather than v-shaped. The linkage arms 134 are crossed between the longerons. The ends of the linkage arms 134 are offset from the hinges between longerons at both the top and bottom of the mast.

As in other embodiments, one hinge 135 of hinge linkage 133 allows the two attached longerons fold in. The other hinge 136 of hinge linkage 133 is an offset hinge and allows its two attached longerons to fold against each other as described above. Truss diagonals 135 are attached to opposing diagonal hinges 135/136.

In sum, mast 10 allows for a mechanically deterministic passively deployed support structure. Deployment is internally synchronized regardless of how many sections are used for the mast. The mast is easily scalable in size, geometry, mass of payload, quantity of solar panels, root attachment, and deployment force.

Figure 12:
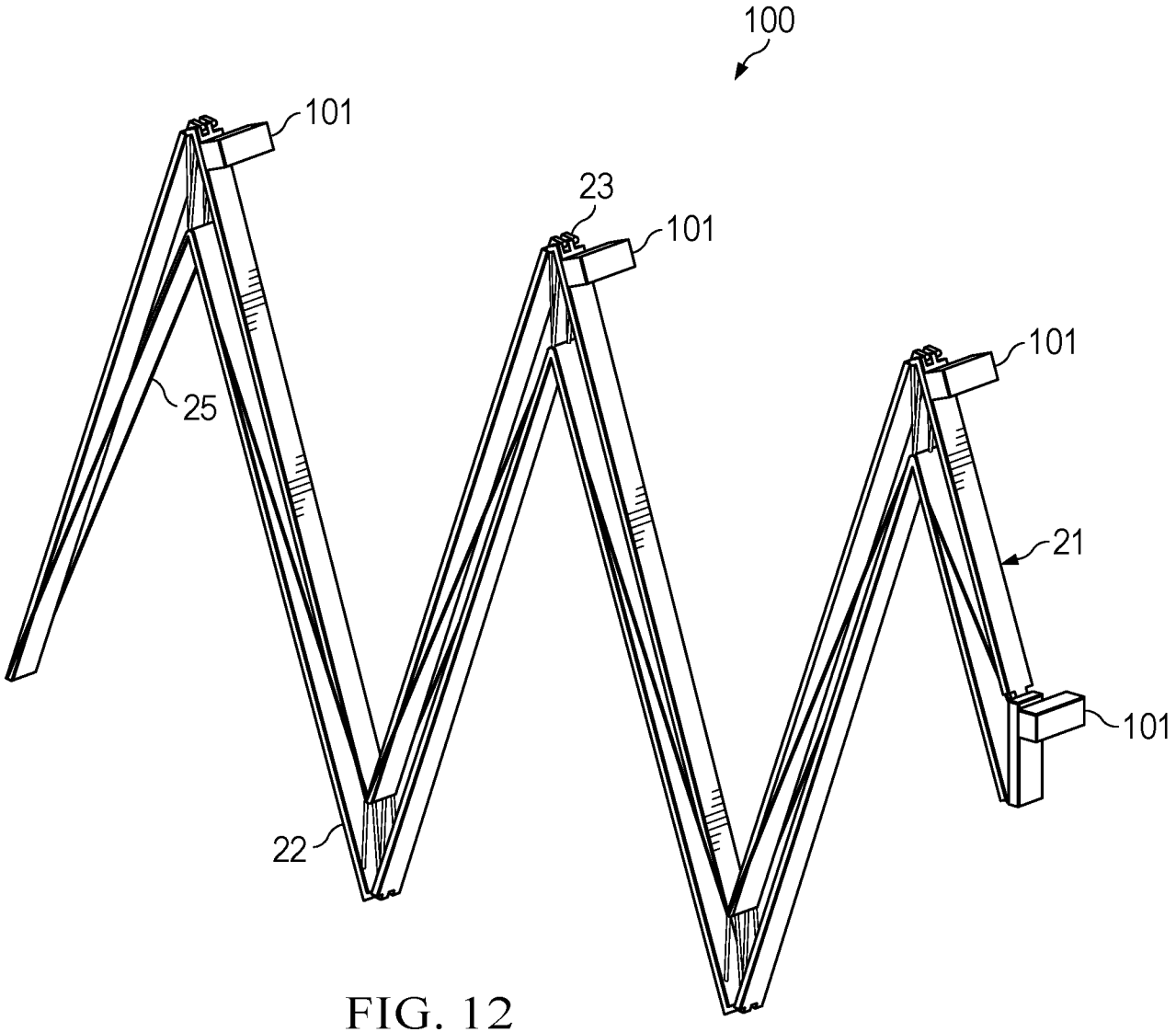
FIG. 12 illustrates an embodiment of the mast in which deployment is achieved using motors rather than springs.

FIG. 12 illustrates an embodiment of the mast in which deployment is achieved using motors rather than springs. This embodiment is like the above embodiments in the sense that once deployment is initiated, the deployment is self-actuating and needs no external control from a base station (such as a spaceship) during deployment.

Specifically, mast 100 has motors 101 installed at hinge linkages 23. In the example of FIG. 12, motors 101 rotate the hinge linkages 23 with respect to the top longerons 21, and thus actuate two sections. Alternatively or in addition, motors could be used to rotate the bottom longerons 22. Or motors could be placed at every hinge linkage 23. In general, it is expected that deployment can be achieved with a motor 101 to rotate at least every other hinge linkage 23.

As in the above-described embodiments an initial release or trigger is used to initiate deployment, but then the mast self-deploys. For example, motors 101 may be powered on a latch circuit that runs until the mechanism hits a limit switch which then kills power. Switch logic could be used to drive motors 101, again not requiring the base station to help control deployment. Motors 101 may be powered by any conventional means used to power electric motors.

During deployment, motors 101 provide torque to the hinge linkages 123. In a manner similar to the above-described springs, motors 101 open the hinge linkages 123 and create tension in the truss diagonals 25.

What is claimed is:

1. A passively deployable mast, comprising:

a series of bottom longerons;

a series of top longerons;

hinge linkages operable to attach the bottom longerons to the top longerons of adjacent sections, such that pairs of bottom longerons and top longerons form a series of parallelogram sections operable to fold and unfold as accordion pleats fold and unfold;

at least one spring associated with each parallelogram section, each spring attached diagonally from at or near one end of a top longeron to at or near an opposing end of a bottom longeron;

wherein the springs are battens configured to be placed in a loaded state by being buckled;

at least one diagonal associated with each parallelogram section;

wherein the springs are operable to deploy the mast from a folded position to a deployed position; and wherein each diagonal is operable to become in tension diagonally in response to a force of an associated spring, which diagonal will then extend across a respective parallelogram section by the action of the springs when the mast is deployed into a final deployed position.

2. The mast of claim 1, wherein the diagonals are implemented with flexible wire, cable, cord, or rod.

3. The mast of claim 1, wherein the longerons of each section have a first side and a second side and at least one spring and one diagonal on each side.

4. The mast of claim 1, wherein each hinge linkage comprises a first hinge connecting two adjacent longerons, a second hinge connecting the other two adjacent longerons, and a pair of linkage arms, and wherein the second hinge is an offset hinge.

5. A method of deploying a mast, comprising:

providing a folded mast comprising:

a series of bottom longerons;

a series of top longerons;

hinge linkages operable to attach the bottom longerons to the top longerons of adjacent sections, such that pairs of bottom longerons and top longerons form a series of parallelogram sections operable to fold and unfold as accordion pleats fold and unfold;

at least one spring associated with each parallelogram section each spring attached diagonally from at or near one end of a top longeron to at or near an opposing end of a bottom longeron;

wherein the springs are battens configured to be placed in a loaded state by being buckled;

at least one diagonal associated with each parallelogram section;

wherein the springs are operable to deploy the mast from a folded position to a deployed position; and wherein each diagonal is operable to become in tension diagonally, in response to a force of an associated spring, which diagonal will then extend across a respective parallelogram section by the action of the springs when the mast is deployed into a final deployed position; and actuating the mast such that the springs are operable to deploy the mast from a folded position to a deployed position, and such that each diagonal is operable to become in tension diagonally across a respective parallelogram by the action of the springs when the mast is deployed into a final position.

6. The method of claim 5, further comprising damping the actuating step.

7. The method of claim 5, wherein the diagonals are implemented with flexible wire, cable, cord, or rod.

8. The method of claim 5, wherein each of the pairs of bottom longerons and top longerons have a first side and a second side and at least one spring and one diagonal on each side.

* * * * *